US006077100A

United States Patent [19]

Sakano

[11] Patent Number: 6,077,100

[45] Date of Patent: Jun. 20, 2000

[54] ELECTRICAL CONNECTOR ASSEMBLY EQUIPPED WITH MEANS FOR SIMULTANEOUSLY MATING ITS PLUG AND RECEPTACLE CONNECTORS

[75] Inventor: Masahiro Sakano, Ebina, Japan

[73] Assignee: Molex Incorporated, Lisle, Ill.

[21] Appl. No.: 09/118,659

[22] Filed: Jul. 17, 1998

[30] Foreign Application Priority Data

Jul. 18, 1997 [JP] Japan ..... 9-209891

[51] Int. Cl.[7] ..... H01R 13/627

[52] U.S. Cl. ..... 439/347; 439/157; 439/359

[58] Field of Search ..... 439/157, 152–156, 439/158–160, 341, 342, 347, 359

[56] References Cited

U.S. PATENT DOCUMENTS 5,169,327 12/1992 Hatagishi ..... 439/157
5,205,752 4/1993 Taguchi et al. ..... 439/157
5,244,400 9/1993 Hatagishi ..... 439/157
5,308,255 5/1994 Yamanashi ..... 439/157
5,431,573 7/1995 Endo et al. ..... 439/157
5,478,255 12/1995 Hashiguchi ..... 439/342
5,681,175 10/1997 Busse et al. ..... 439/157
5,921,791 7/1999 Ono et al. ..... 439/157

*Primary Examiner*—Hien Vu
*Attorney, Agent, or Firm*—Stacey E. Caldwell

[57] ABSTRACT

Disclosed is an improved electric connector assembly which is compact in size, and is capable of simultaneously mating its plug and receptacle connectors (1*a*, 2*a*, 1*b*, 2*b*). Each connector has integrally formed projections (7*a*, 11*a*, 7*b*, 11*b*) on its sides, and a cover (13) encloses the plug and receptacle connectors (1*a*, 2*a*, 1*b*, 2*b*). The cover (13) has slider plates (14) which have guide slots (15, 16, 17, 18) to accommodate the projections (7*a*, 11*a*, 7*b*, 11*b*) and cause them to move toward each other when the slider plates (14) are moved laterally thereby pulling the plug connectors (1*a*, 1*b*) and the receptacle connectors (2*a*, 2*b*) toward one another by way of the projections and slot cam action until the connectors are fully mated.

4 Claims, 3 Drawing Sheets

ELECTRICAL CONNECTOR ASSEMBLY EQUIPPED WITH MEANS FOR SIMULTANEOUSLY MATING ITS PLUG AND RECEPTACLE CONNECTORS

FIELD OF THE INVENTION

The present invention relates to an electrical connector assembly equipped with means for simultaneously mating its plug and receptacle connectors.

BACKGROUND OF THE INVENTION

Typical plug and receptacle connectors are mated together by hand. In some instances, however, larger plug and receptacle connectors are mated together with mating tools using leverage or screws.

However, use of such mating tools limits the freedom of designing, and extra space is required for equipping the electric connector with such a mating tool. For example, where a mating tool uses a screw, the screw is fixed to the center of the connector to permit the mating force to be distributed evenly. This arrangement makes it difficult to reduce the size of the connector. Similarly, for a leverage tool, such as a lever or cam, a relatively large space is required to permit rotation of the lever or cam about a fulcrum in the connector.

SUMMARY OF THE INVENTION

An object of the present invention is to provide an electrical connector assembly comprising a plurality of plug and receptacle connectors, which assembly is relatively small in size and which is capable of simultaneously mating the plug and receptacle connectors.

To attain this object, an electrical connector assembly according to the present invention comprises a plurality of plug and receptacle pairs each having projections integrally formed on their opposite sides; mating means for mating the plug and receptacle connectors, said mating means including a cover for enclosing the plug and receptacle pairs, wherein said cover includes slider plates slidably attached thereto, each slider plate having guide slots to accommodate said projections, and to cause them to move toward each other during movement of said slider plates; and driving means for driving said slider plates laterally, thereby pulling said plug connectors and said receptacle connectors toward one another until they are fully mated.

The driving means comprises a threaded rod rotatably fixed to said cover and a rising and descending member having actuator projections formed on its sides, wherein each of said slider plates has an oblique slot made thereon to accommodate said actuator projections.

The guide slots of the slider plate comprise first guide slots to accommodate the projections of the receptacle connectors and second guide slots to accommodate the projections of the plug connectors. Each of the first guide slots includes a vertical slot section and a horizontal slot section extending laterally from the end of the vertical slot section. Each of the second guide slots includes an oblique slot section and a horizontal slot section extending laterally from the end of the oblique slot section.

Other objects and advantages of the present invention will be understood from the following description of an electric connector assembly according to a preferred embodiment of the invention in conjunction with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DESCRIPTION OF THE PREFERRED EMBODIMENT

An electric connector assembly according to the present invention is described below as including two plug and receptacle connector pairs 1*a* and 2*a*, 1*b* and 2*b*, but could easily describe a connector assembly having a single connector pair or any reasonable amount of connector pairs.

Figure 1:
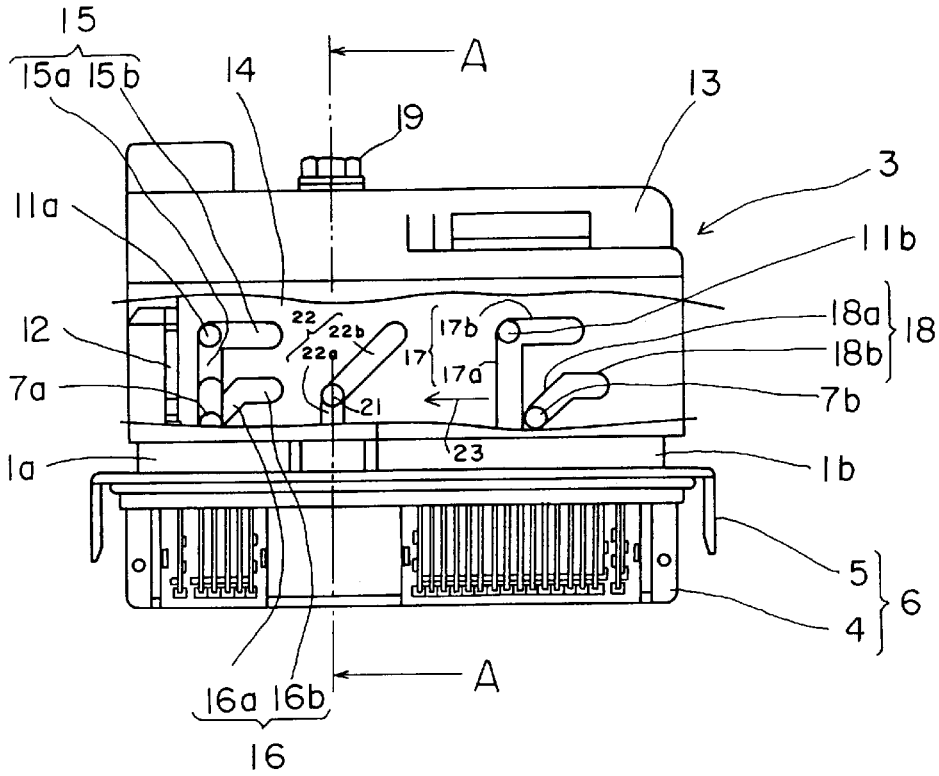
FIG. 1 is a front view of an electric connector assembly according to the present invention, the cover of which electric connector assembly is partly broken away to show the inside, showing the slider plate of the connector assembly during the second stage in mating.
Figure 2:
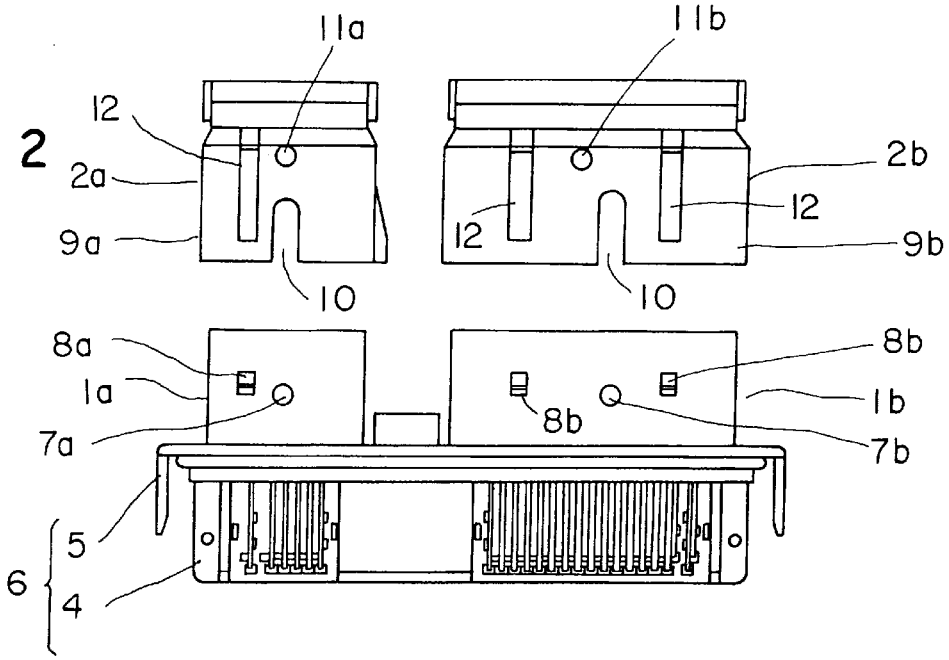
FIG. 2 is a front view of the electric connector assembly with the cover removed.

In FIG. 1, the electric connector assembly is shown at a second stage in mating. Looking at FIG. 2 in conjunction with FIG. 1, the connector assembly comprises two plug and receptacle connector pairs 1*a* and 2*a*, and 1*b* and 2*b*, and a cover 13 for enclosing the plug and receptacle connectors. The plug connectors 1*a* and 1*b* are carried by a support assembly 6, which is composed of a printed circuit board 4 and a support 5. In the illustrated embodiment, plug connector 1*a* includes 30 plug terminals and plug connector 1*b* has 80 plug terminals (shown generally in FIG. 5). Obviously many different circuit sizes can be used for one or both of the plug and receptacle connector pairs. However, larger circuit size plug connectors, such as 1*a* and 1*b*, require a relatively strong force to mate with the mating receptacle connectors 2*a* and 2*b*. Accordingly, this invention is directed to such larger circuit size plug and receptacle connector pairs.

Mating receptacle 2*a* and 2*b* each include an enclosure 9*a* and 9*b*, respectively, adapted to be press-fit over the respective plug connector. Each plug connector 1*a* and 1*b* includes initial engagement projections 8*a* and 8*b*, respectively, and slider-engagement projections 7*a* and 7*b* integrally formed on the sides of the connector. Similarly, each receptacle connector 2*a* and 2*b* has slider-engagement projections 11*a* and 11*b* integrally formed on the sides of enclosure 9*a* and 9*b*. Also, enclosures 9*a* and 9*b* of respective receptacle connectors 2*a* and 2*b* have vertical slots 10 formed on their sides, thereby allowing slider-engagement projections 7*a* and 7*b* to advance in vertical slots 10 when plug connectors 1*a* and 1*b* are mated with receptacle connectors 2*a* and 2*b*. Thus, enclosures 9*a* and 9*b* of receptacle connectors 2*a* and 2*b* provide no interference and actually provide guidance and alignment assistance during mating with plug connectors 1*a* and 1*b*. Each enclosure 9*a* and 9*b* of receptacle connectors 2*a* and 2*b* further includes initial engagement slots 12 formed on each side of the enclosure. These initial engagement slots 12 accommodate the initial engagement projections 8*a* and 8*b* of the plug connectors when the receptacle connectors and the plug connectors are in an initial engagement position (see FIG. 3), that is, where slider-engagement projections 11*a* and 11*b* of receptacle connectors 2*a* and 2*b* and slider-engagement projections 7*a* and 7*b* of plug connectors 1*a* and 1*b* are initially aligned, prior to final engagement.

Cover 13 encloses plug and receptacle pairs 1*a*, 2*a*, 1*b* and 2*b* (see FIG. 3), and a plurality of electric wires (not shown) pass through cover 13 for connecting to receptacle terminals of receptacle connectors 2*a* and 2*b*. Cover 13 includes slider plates 14 slidably attached to the cover such that each plate faces a side of each of the plug and receptacle connectors. Slider plates 14 are adapted to move laterally in the direction of arrow 23 in FIG. 1. The slider plates 14 move and guide the slider-engagement projections 7*a* and 7*b* of the plug connectors and the slider-engagement projections 11*a* and 11*b* of the receptacle connectors toward each other during mating. Each slider plate 14 has first and second guide slots 15, 16, 17 and 18 which accommodate slider-engagement projections 11*a*, 7*a*, 11*b* and 7*b*, respectively, and a third guide slot 22 which accommodates an actuator projection 21, described in more detail below.

Specifically, first guide slots 15 and 17 accommodate slider-engagement projections 11*a* and 11*b*, respectively, of receptacle connectors 2*a* and 2*b*, and comprise vertical slot sections 15*a* and 17*a* and horizontal slot sections 15*b* and 17*b* which extend laterally from the vertical slot sections. Second guide slots 16 and 18 accommodate projections 7*a* and 7*b*, respectively, of plug connectors 1*a* and 1*b*, and comprise oblique slot sections 16*a* and 18*a* and horizontal slot sections 16b and 18*b* which extend laterally from the oblique slot sections. The vertical distance between the horizontal slot sections 15*b* and 17*b* and 16*b* and 18*b* is equal to the vertical distance between slider-engagement projections 7*a* and 7*b* of plug connectors 1*a* and 1*b* and slider-engagement projections 11*a* and 11*b* of receptacle connectors 2*a* and 2*b* at their final mating position.

Finally, third guide slot 22 comprises a vertical slot section 22*a* and an oblique slot section 22*b* which extends from the end of the vertical slot section.

Figure 5:
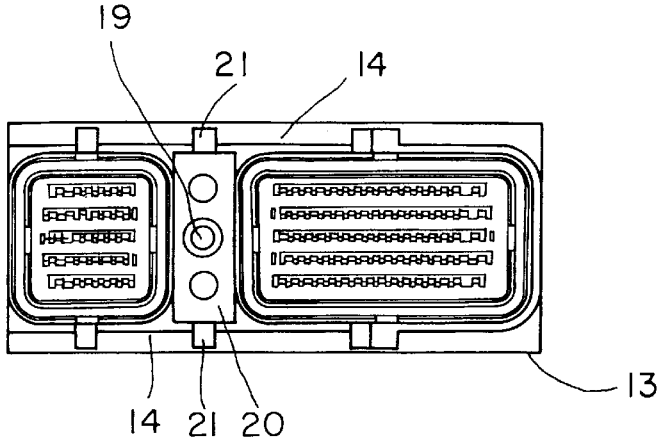
FIG. 5 is a bottom view of the receptacle connectors press-fit within the cover.
Figure 6:
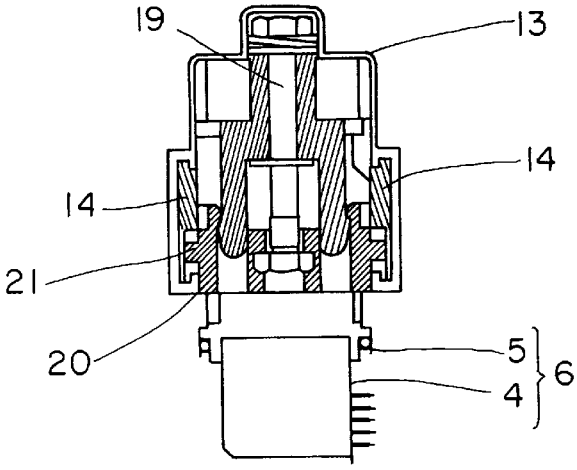
FIG. 6 is a cross section of the electric connector assembly taken along the line A—A in FIG. 1.
Figure 7:
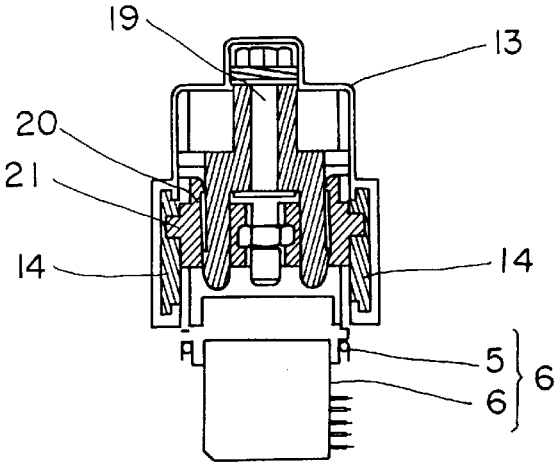
FIG. 7 is a cross section of the electric connector assembly taken along the line B—B in FIG. 4.

Looking to FIGS. 5–7, a driving means to effect movement of the slider plates 14 laterally comprises a threaded rod 19 rotatably fixed to cover 13 and a rising and descending member 20 movably connected to the threaded rod. The rising and descending member 20 has actuator projections 21 formed on each side which are adapted to be accommodated in third guide slots 22. Rotation of threaded rod 19 raises rising and descending member 20 and therefore moves slider plates 14 laterally (in the direction of arrow 23 in FIG. 1) by way of actuator projections 21 moving through guide slots 22.

Figure 3:
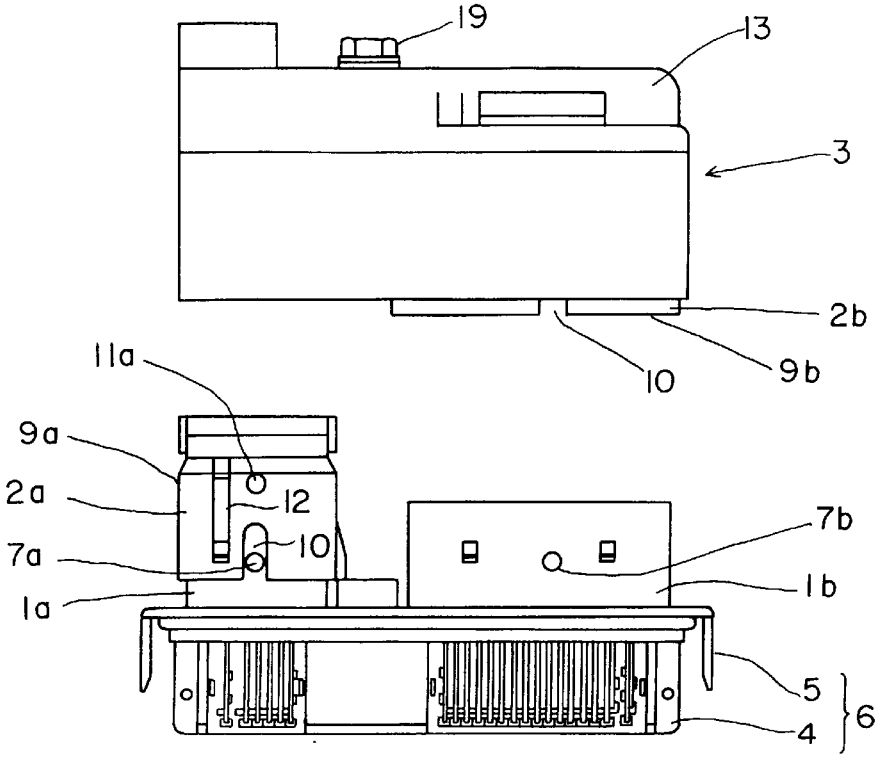
FIG. 3 is a front view of the electric connector assembly, showing the plug and receptacle connectors during the first stage in mating.
Figure 4:
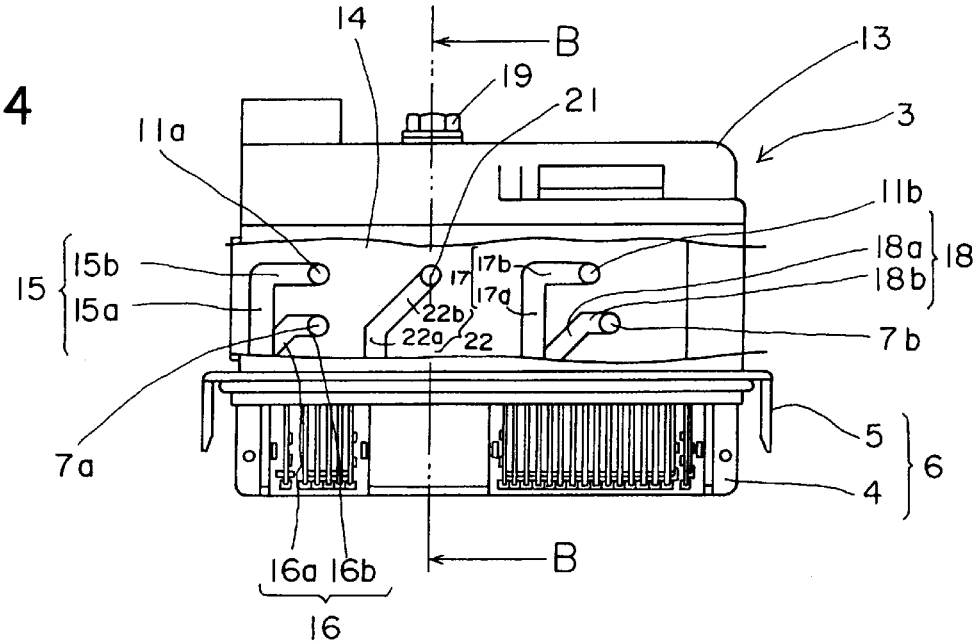
FIG. 4 is a front view of the electric connector assembly, the cover of which electric connector assembly is partly broken away to show the inside, showing the slider plate on the plug and receptacle connectors during the third or final stage in mating.

Referring back to Figures. 1, 3 and 4, the manner in which the plug connectors 1*a* and 1*b* are mated with receptacle connectors 2*a* and 2*b* is described below. Initially and during the first stage in mating, the receptacle connectors 2*a* and 2*b* and mating plug connectors 1*a* and 1*b* are put in their initial position by positioning the initial engagement projections 8*a* and 8*b* in the corresponding initial engagement slot 12, as seen in FIG. 3. At a second stage, cover 13, through which electric wires extend from receptacle terminals of receptacle connectors 2*a* and 2*b*, is press-fit onto plug connectors 1*a* and 1*b*, permitting slider-engagement projections 7*a* and 7*b* of plug connectors 1*a* and 1*b*, slider-engagement projections 11*a* and 11*b* of receptacle connectors 2*a* and 2*b* and actuator projections 21 of rising and descending member 20 to line up with guide slots 16, 18, 15, 17 and 22, respectively, of slider plates 14. Then, rising and descending member 20 is raised to its highest position by rotating threaded rod 19, as seen in FIG. 1.

When rising and descending member 20 is at its highest position, slider-engagement projections 7*a* and 7*b* enter oblique slot sections 16*a* and 18*a* of guide slots 16 and 18, and slider-engagement projections 11*a* and 11*b* enter horizontal slot sections 15*b* and 17*b* of guide slots 15 and 17. Further rotation of threaded rod 19 moves slider plates 14 in the direction indicated by arrow 23 in FIG. 1 as actuator projections 21 move within oblique slot sections 22*b* and allow slider-engagement projections 11*a* and 11*b* to move within hollow slot sections 15*b* and 17*b*, and, at the same time, allow slider-engagement projections 7*a* and 7*b* to move within oblique slot sections 16*a* and 18*a* and then within horizontal slot sections 16*b* and 18*b*. Thus, slider-engagement projections 7*a* and 7*b* are pulled toward slider-engagement projections 11*a* and 11*b*, and, accordingly, plug connectors 1*a* and 1*b* are pulled toward receptacle connectors 2*a* and 2*b* until they are fully mated, as in FIG. 4.

As understood from the above, two or more plug and receptacle connector pairs can be mated simultaneously simply by rotating the threaded rod, which requires only a small amount of rotating force. The threaded rod and associated rising and descending member along with the slider plates require little space in the connector assembly, thus permitting the connector size to remain relatively small. The relative arrangement of the slider-engagement and actuator projections and the associated guide slots helps distribute the mating forces evenly, thereby eliminating any twisting or "zippering" during mating of the connector assembly. These projections are formed on opposite sides of the plug and receptacle connectors, thus providing little interference with the inside components, and minimizing the effect on the freedom of connector design in general.

The connector assembly is thus described as comprising plug and receptacle connector pairs each having a single pair of slider-engagement projections on each side of the connector pair, but the plug and receptacle connector pairs could include two or more pairs of slider-engagement projections, and, correspondingly, the slider plates would include a corresponding number of guide slots.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly comprising:

a plug and receptacle connector (1*a*, 2*a*) each having an integrally formed projection (7*a*, 11*a*) thereon;

means for mating the connectors (3) in a mating direction including a cover (13) for enclosing the plug and receptacle connectors, said cover (13) having a slider plate (14) with guide slots (15, 16) to accommodate the projections (7*a*, 11*a*) on the connectors; and means for driving said slider plate (19, 20, 21, 22) in a lateral direction perpendicular to the mating direction comprising a threaded rod (19) rotatable fixed to said cover (13) and a rising and descending member (20) movably connected to said threaded rod (19) and including an actuator projection (21) formed integrally on the rising and descending member, wherein the slider slate (14) includes an oblique slot (22*b*) adapted to accommodate said actuator projection, and wherein as the slider plate moves in the lateral direction, the guide slots cause the projections to move toward one another, thereby pulling the plug connector and the receptacle connector toward one another until the plug and receptacle connectors are fully mated.

2. An electrical connector assembly according to claim 1 wherein said guide slots (15, 16) comprise a first guide slot (15) to accommodate the projection (11*a*) on the receptacle connector (2*a*), and second guide slot (16) to accommodate the projection (7*a*) on the plug connector (1*a*), wherein the first guide slot includes a vertical slot section (15*a*) and a horizontal slot section (15*b*) laterally extending from the vertical slot section, and the second guide slot includes an oblique slot section (16*a*) and a horizontal slot section (16*b*) extending laterally from the oblique slot section.

3. An electrical connector assembly comprising a plurality of plug and receptacle connector pairs (1*a*, 2*a*, 1*b*, 2*b*,) each plug and receptacle having integrally formed projections (7*a*, 11*a*, 7*b*, 11*b*) thereon;

means for mating the plug and receptacle connector pairs (3) in a mating direction, including a cover (13) for enclosing the plug and receptacle pairs, said cover (13) having a pair of slider plates (14) slidably attached thereto, each of the slider plates (14) having guide slots (15, 16, 17, 18) to accommodate the projections (7*a*, 11*a*, 7*b* 11*b*) on the plug and receptacle connector pairs; and driving means (19, 20, 21, 22) for driving said slider plates (14) in a lateral direction perpendicular to the mating direction comprising a threaded rod (19) rotatable fixed to said cover (13), and a rising and descending member (20) movably connected to said threaded rod (19), the rising and descending member (20) including actuator prolections (21), wherein each of said slider plates (14) includes an oblique slot (22*b*) to accommodate said actuator projections (21), and wherein, as the slider plates move, the guide slots cause the projections of the plug and receptacle connector pairs to move toward one another, thereby pulling the plug connectors and the receptacle connectors toward one another until the plug and receptacle connectors are fully mated.

4. An electrical connector assembly according to claim 3 wherein said guide slots (15, 16, 17, 18) include first guide slots (15, 17) to accommodate projections (11*a*, 11*b*) on said receptacle connectors (2*a*, 2*b*), and second guide slots (16, 18) to accommodate projections (7*a*, 7*b*) on said plug connectors (1*a*, 1*b*), wherein each first guide slot comprises a vertical slot section (15*a*, 17*a*) and a horizontal slot section (15*b*, 17*b*) laterally extending from the vertical slot section, and each second guide slot comprises an oblique slot section (16*a*, 18*a*) and a horizontal slot section (16*b*, 18*b*) extending laterally from the oblique slot section.

* * * * *